United States Patent [19]

Floreancig

[11] 4,381,286

[45] Apr. 26, 1983

[54] PROCESS FOR THE SELECTIVE SEPARATION OF URANIUM AND MOLYBDENUM WHICH ARE CONTAINED IN AN AMINO SOLVENT

[75] Inventor: Antoine Floreancig, Saint Genis Laval, France

[73] Assignee: Uranium Pechiney Ugine Kuhlmann, Paris, France

[21] Appl. No.: 271,941

[22] Filed: Jun. 9, 1981

[30] Foreign Application Priority Data

Jun. 19, 1980 [FR] France ..... 80 13912

[51] Int. Cl.[3] ..... C01G 43/00; C01G 39/00

[52] U.S. Cl. ..... 423/9; 423/54

[58] Field of Search ..... 423/9, 54

[56] References Cited

U.S. PATENT DOCUMENTS

| | | | |
|---|---|---|---|
| 3,052,513 | 9/1962 | Crouse | 423/9 |
| 3,083,076 | 3/1963 | Drobnick et al. | 423/9 |
| 3,156,524 | 11/1964 | Drobnick et al. | 423/9 |
| 3,223,476 | 12/1965 | Hart et al. | 423/9 |
| 3,241,909 | 3/1966 | Henrickson | 423/9 |
| 4,188,361 | 2/1980 | Bowden | 423/9 |

*Primary Examiner*—Herbert T. Carter

*Attorney, Agent, or Firm*—Dennison, Meserole, Pollack & Scheiner

[57] ABSTRACT

The present invention relates to a process for the selective separation of uranium and molybdenum which are contained in an extract resulting from an amino solvent liquid-liquid extraction of a solution resulting from an attack on a molybdo-uraniferous ore by means of sulphuric acid, and which comprises re-extraction of the uranium in the presence of an oxidizing agent by means of an acid solution of an alkali metal chloride, followed by re-extraction of the molybdenum by means of an alkali metal carbonate solution. This process is characterized by using an oxidizing agent such as hydrogen peroxide, a small amount of which is added to the acid alkali metal chloride solution before the latter is brought into contact with the extract. This makes it possible to achieve selective separation of the uranium and molybdenum. This process can be used wherever molybdo-uraniferous ores are treated and where there is a requirement to produce a uranium concentrate which complies with the limits set in regard to the molybdenum content.

5 Claims, 1 Drawing Figure

PROCESS FOR THE SELECTIVE SEPARATION OF URANIUM AND MOLYBDENUM WHICH ARE CONTAINED IN AN AMINO SOLVENT

BACKGROUND OF THE INVENTION

The present invention relates to a process for the selective separation of uranium and molybdenum which are contained in an extract resulting from the treatment by liquid-liquid extraction by means of an amino solvent, of a solution resulting from the attack on a molybdouraniferous ore, comprising effecting aqueous re-extraction of the uranium contained in said extract in the presence of an oxidizing agent and by means of an acid solution of an alkali metal chloride followed by re-extraction of the molybdenum by treating the residual extract by means of an alkali metal carbonate solution and recycling of the amino solvent to the initial extraction operation.

It is well known to the man skilled in the art for the liquors resulting from the attack on molybdouraniferous ores by means of sulpheric acid to be treated by liquid-liquid extraction using an amino solvent. In the course of that operation, the uranium and the molybdenum pass from the liquor into the organic solvent to form what is referred to as an extract.

It is also known that the uranium and the molybdenum which are contained in the extract can be separated by first effecting an operation of re-extraction of the uranium by means of an acid aqueous solution of an alkali metal salt such as a sodium or ammonium chloride thereby to produce an aqueous uranium solution which is then treated either with ammonia, or magnesia, or sodium carbonate, or lime, to precipitate therefrom the corresponding uranate.

The residual extract which contains the molybdenum is then in turn subjected to a re-extraction operation using an alkaling solution such as ammonia, sodium carbonate or ammonium carbonate, which are used alone or in mixture, and the resulting aqueous solution is then also treated with lime or another base so as to isolate molybdic compound therefrom.

After these two re-extraction operations, the organic amino solvent is recycled to the initial extraction step.

However, when used for treating molybdo-uraniferous ores, such a process suffered from the disadvantage of resulting in the formation of an insoluble complex as between the molybdenum and the amino solvent, and hence the occurrence of solid fouling materials which interfered with ion transfers in the initial liquid-liquid extraction operation.

However, U.S. Pat. No. 3,156,524 has shown that the existence of the above-mentioned fouling materials was due to the presence of molybdenum in molybdenyl form and that it was only necessary to add an oxidizing agent to the extract before carrying out the re-extraction operations in order to produce the molybdenum in the molybdate state, thereby to overcome the above-mentioned disadvantage.

The applicants, experimenting with the process in accordance with the teaching of the patent, on molybdenum-rich solutions, found that the aqueous uranium solution produced contained relatively substantial amounts of molybdenum which in most cases exceeded the limit which is accepted at the present time by the users of uranium concentrates, which is to have a weight ratio as follows:

$$Mo/U < 1400.10^{-6}$$

Moreover, this disadvantage was more marked in proportion as the amount of molybdenum accompanying the uranium increased. Now, the present-day tendency is to seek to make maximum use of ores and therefore to use even those ores which have a very high impurity content. This is the case in regard to molybdo-uraniferous ores. This development can be noted if reference is made to U.S. Pat. No. 3,156,524 in which the solutions resulting from the attack operation, which appear in Example 1, contain $U_3O_8$ 1.85 g/l and Mo 0.058 g/l, that is to say Mo/U=3.8%, whereas at the present time efforts are made to treat ores which result in solutions in which the ratio Mo/U may be higher than 100%.

SUMMARY OF THE INVENTION

The present invention relates to the treatment, inter alia, of molybdenum-rich solutions, and makes it possible to achieve selective separation, that is to say, in the re-extraction of uranium, to produce an aqueous solution in which the ratio:

$$Mo/U < 1400.10^{-6}$$

It is characterised in that an oxidizing agent is added to the acid solution of alkali metal chloride before the latter is brought into contact with the extract.

The applicants have surprisingly noted in fact that the degree of selectivity of the separation operation was substantially improved when the oxidizing agent was previously added to the re-extraction solution before being brought into contact with the extract, in comparison with the degree of separation selectivity achieved by using the process which is disclosed in U.S. Pat. No. 3,156,524 and which comprises adding the oxidizing agent to the extract and then bringing it into contact with the re-extraction solution, while being aware that, in the latter case, the only function performed by the oxidizing agent is to suppress the fouling materials, and not to play any part in regard to selectivity.

Moreover, the applicants also found that preferably hydrogen peroxide, unlike chlorates, chlorine and other oxidizing agents, had the capability of improving the degree of selectivity and that moreover the amount to be used was relatively low and generally less than 50 g/kg U to be recovered, this applying for a value in respect of the ratio Mo/U in the extract, which may reach 200%.

The uranium re-extraction stage is performed by means of mixer-settlers in which there is counter-current circulation of the amino solvent which is charged with uranium and molybdenum, and the alkali metal chloride solution which is progressively enriched in respect of uranium in the course of contact thereof with the solvent.

Preferably, the invention uses a battery comprising a plurality of mixer-settlers and the oxidizing agent is mixed with the re-extraction solution before the latter carries out its function with respect to the amino solvent, that is to say, the oxidizing agent is involved at the level of all the mixer-settlers.

However, in an alternative form, it is also possible for the oxidizing agent to be introduced into the circuit of the aqueous re-extraction solution either between the first and the second mixer-settlers or between any two mixer-settlers.

DETAILED DESCRIPTION OF THE INVENTION

Figure 1:
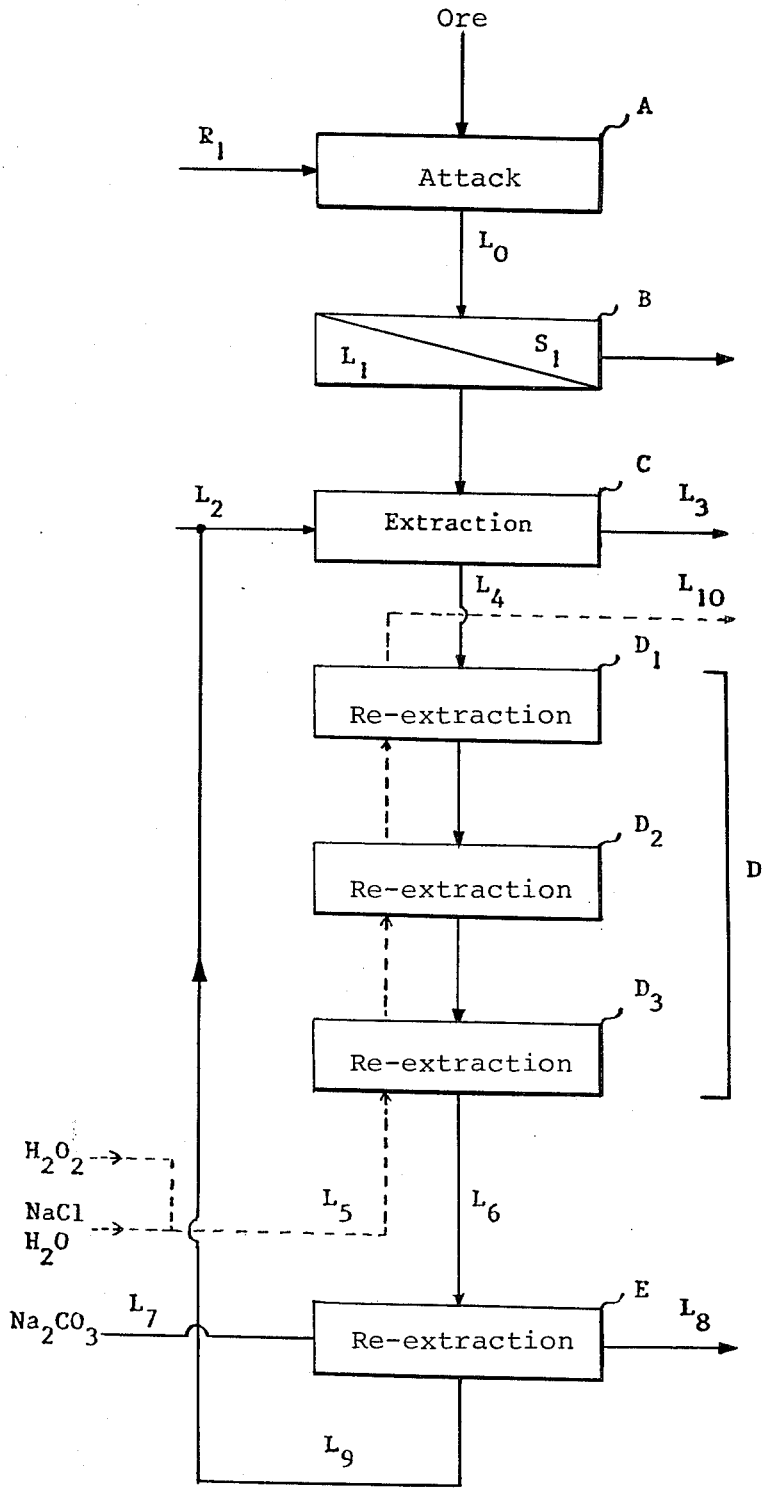
FIG. 1 is a flow diagram of an exemplary mode of carrying forth a process comprising the present invention.

The invention will be better appreciated by reference to the single FIGURE of drawings which shows an attack reaction vessel A which is supplied with ore and with attack reactants $R_1$. From this apparatus there issues a suspension $L_0$ which, by filtration in B, gives a solid residue $S_1$ which is removed from the circuit, and a liquor $L_1$ which is subjected to liquid-liquid extraction in C by means of an amino solvent $L_2$, thereby to produce an aqueous raffinate $L_3$ which is capable of being treated for recovering therefrom certain elements, and an extract $L_4$ which is passed to the uranium re-extraction stage in D which in the present case comprises three mixer-settlers $D_1$, $D_2$ and $D_3$. In these three pieces of equipment, $L_4$ is brought into contact with a liquor $L_5$ comprising an acid aqueous solution of sodium chloride to which hydrogen peroxide has been added. As it circulates, $L_4$ progressively gives up the uranium that it contains, to produce a liquor $L_6$ which contains the essential part of the molybdenum and which is treated in E using an aqueous sodium carbonate solution $L_7$ to give an aqueous molybdenum liquor $L_8$ and an amino solvent $L_9$ which can be recycled to the initial extraction step C with a pure solvent $L_2$, while $L_5$ is enriched with uranium in the course of its flow through $D_3$, $D_2$ and $D_1$ to give an aqueous solution $L_{10}$ which is ready to be converted into a uraniferous concentrate by precipitation by means of a base.

The following Examples demonstrate the attraction of the process of the invention in regard to selectivity of the uranium-molybdenum separation operation.

EXAMPLE 1

An extract resulting from an extraction operation using a solvent of the tertiary amino type containing 2 g/l of uranium and 2 g/l of molybdenum was subjected to re-extraction using an aqueous solution containing 1.5 gram-molecule of NaCl per liter and 0.1 gram-molecule per liter of $H_2SO_4$, to which there was added, prior to any contact with the extract, 30 g of hydrogen peroxide per kilogram of uranium to be recovered.

The aqueous solution resulting from this re-extraction step contains amounts of uranium and molybdenum in the ratio $Mo/U=496.10^{-6}$.

Another experiment is carried out under the same conditions, but without adding hydrogen peroxide. The resulting ratio Mo/U is then $2770.10^{-6}$.

This example shows the influence of oxidation on the degree of selectivity of uranium-molybdenum separation.

EXAMPLE 2

An extract resulting from an extraction operation using an amino solvent containing 1.7 g/l of uranium and 1.5 g/l of molybdenum is brought into contact, with agitation, with an aqueous re-extraction solution containing 80 g/l of NaCl, 20 g/l of $Na_2SO_4$ and an amount of $H_2SO_4$ sufficient to give a pH-value of 2.

In a first test, 0.3 cc of a 34 g/l $NaClO_3$ solution is added to the aqueous re-extraction solution.

In a second test, 0.3 cc of 34 g/l hydrogen peroxide is added, which corresponds to an amount of active oxygen which is substantially the same in both cases.

The aqueous uranium solutions obtained respectively have a ratio Mo/U of $1800.10^{-6}$ and $900.10^{-6}$.

This shows that the nature of the oxidising agent, for the purposes of improving the degree of separation selectivity is an influencing factor and that hydrogen peroxide is preferable to the chlorate.

EXAMPLE 3

In a first test carried out under the conditions in accordance with the invention, one liter of an extract containing 3.6 g/l of uranium and 1.6 g/l of molybdenum is brought into contact, with agitation, with 0.1 liter of an aqueous solution of sodium chloride, containing 80 g/l of NaCl, 20 g/l of $Na_2SO_4$, 0.5 g/l of $H_2SO_4$ and 0.5 g/l of $H_2O_2$.

In a second test, one liter of the same amino extract containing 3.6 g/l of uranium and 1.6 g/l of molybdenum is treated, in a first phase, with the same amount of hydrogen peroxide, that is to say, 50 mg of $H_2O_2$ per liter of extract, and then brought into contact with 0.1 liter of an aqueous solution of sodium chloride containing 80 g/l of NaCl, 20 g/l of $Na_2SO_4$ and 0.5 g/l of $H_2SO_4$.

The resulting aqueous uranium solutions respectively have a ratio Mo/U of $540.10^{-6}$ in the first test and $1960.10^{-6}$ in the second test.

This shows that the efficiency of hydrogen peroxide is better when the hydrogen peroxide is added to the acid alkali metal chloride solution before the latter is brought into contact with the extract.

EXAMPLE 4

1 liter/h of an extract containing 3.6 g/l of uranium and 1.7 g/l of molybdenum resulting from liquid-liquid extraction of the sulphuric attack solution for attacking a molybdo-uraniferous ore, using a solution containing 0.1 gram/molecule of trilaurylamine in kerosene, is treated in counter-current in a battery of three mixer-settlers, by means of 0.13 l/h of an aqueous solution containiing 80 g/l of NaCl, 20 g/l of $Na_2SO_4$ and 1 g/l of $H_2SO_4$.

0.005 l/h of a 10 g/l $H_2O_2$ solution is introduced into the aqueous solution, between $D_1$ and $D_2$. The aqueous uranyl chloride solution $L_{10}$ issuing from $D_1$ contains 27.5 g/l of uranium and 11 mg/l of molybdenum, that is to say, a ratio Mo/U of $400.10^{-6}$.

The present invention can be put to use in any treatments in respect of molybdo-uraniferous ores by sulphuric acid attack and extraction by means of an amino solvent, and in which the degree of selectivity of U-Mo separation is to be improved, in the re-extraction of the uranium by means of an aqueous alkali metal chloride-based solution.

I claim:

1. In a process for the selective separation of the uranium and molybenum which are contained in an extract resulting from the treatment by liquid-liquid extraction by means of an amino solvent of a solution resulting from the attack using sulphuric acid on a molybdo-uraniferous ore comprising aqueous re-extraction of the uranium contained in said extract by means of an acid solution of an alkali metal chloride, followed by re-extraction of the molybdenum by treatment of the residual extract by means of an alkali metal carbonate solution and recycling of the solvent to achieve selective separation, the improvement comprising the step of adding an oxidizing agent to the acid alkali metal chloride solution before the latter is brought into contact with the extract.

2. A separation process according to claim 1 wherein the oxidizing agent used is a hydrogen peroxide solution.

3. A separation process according to claim 1 wherein the aqueous solution resulting from the attack operation contains amounts of molybdenum such that the ratio Mo/U reaches up to about 200%.

4. A separation process according to claim 1 wherein the uranium re-extraction operation is effected by means of a plurality of mixer-settler steps in which the organic solvent and the acid alkali metal chloride solution circulate in counter-current flow.

5. A separation process according to claim 4 wherein the hydrogen peroxide is added to the acid alkali metal chloride solution between two of the mixer-settler steps.

* * * * *